US006781079B1

(12) United States Patent
Hillegers

(10) Patent No.: US 6,781,079 B1
(45) Date of Patent: Aug. 24, 2004

(54) SWITCH ACTUATOR

(76) Inventor: Dick Hillegers, 1/7 Carl Place, Glenfield, Auckland (NZ)

( * ) Notice: Subject to any disclaimer, the term of this patent is extended or adjusted under 35 U.S.C. 154(b) by 0 days.

(21) Appl. No.: 10/049,141

(22) PCT Filed: Aug. 7, 2000

(86) PCT No.: PCT/AU00/00942

§ 371 (c)(1),
(2), (4) Date: Nov. 18, 2002

(87) PCT Pub. No.: WO01/11640

PCT Pub. Date: Feb. 15, 2001

(30) Foreign Application Priority Data

Aug. 6, 1999 (NZ) ..... 337089

(51) Int. Cl.[7] ..... H01H 3/02
(52) U.S. Cl. ..... 218/154; 218/140
(58) Field of Search ..... 218/154, 140, 218/2, 7, 153, 120; 200/400–402

(56) References Cited

U.S. PATENT DOCUMENTS 4,593,165 A * 6/1986 Steinemer ..... 218/140
5,091,616 A * 2/1992 Ramos et al. ..... 218/9
5,186,315 A * 2/1993 Koppe et al. ..... 200/48 V
5,493,090 A * 2/1996 Vestner et al. ..... 218/7
5,821,486 A * 10/1998 Paw et al. ..... 200/48 A
5,856,643 A * 1/1999 Gress et al. ..... 200/50.32

* cited by examiner

*Primary Examiner*—Lincoln Donovan
*Assistant Examiner*—M. Fishman
(74) *Attorney, Agent, or Firm*—Fish & Richardson P.C.

(57) ABSTRACT

The present invention consists in a switch actuator to move an air brake switch (124) such as those commonly found in power transmission lines, between an open and closed position wherein the actuator (4) includes a first rotatable member in mechanical connection with and to move said switch (124) between said open and closed position by the rotation of said rotatable member, a second rotatable member in mechanical connection with an actuator such as a linear drive motor (8), a connection member rotatable about the same pivot axis as the first and second members, the connection member being biased for rotation about the pivot axis in a toggle manner and providing a mechanical connection means to locate (a) against a fixed point of, and be displaced by, said second rotatable means at least during the rotation of the connection member by the second rotation means towards the point of toggle of the connection means, and (b) against a fixed point of and to thereby displace, the first rotatable member at least during rotation of said connection member passed said point of toggle.

25 Claims, 12 Drawing Sheets

Figure 1:
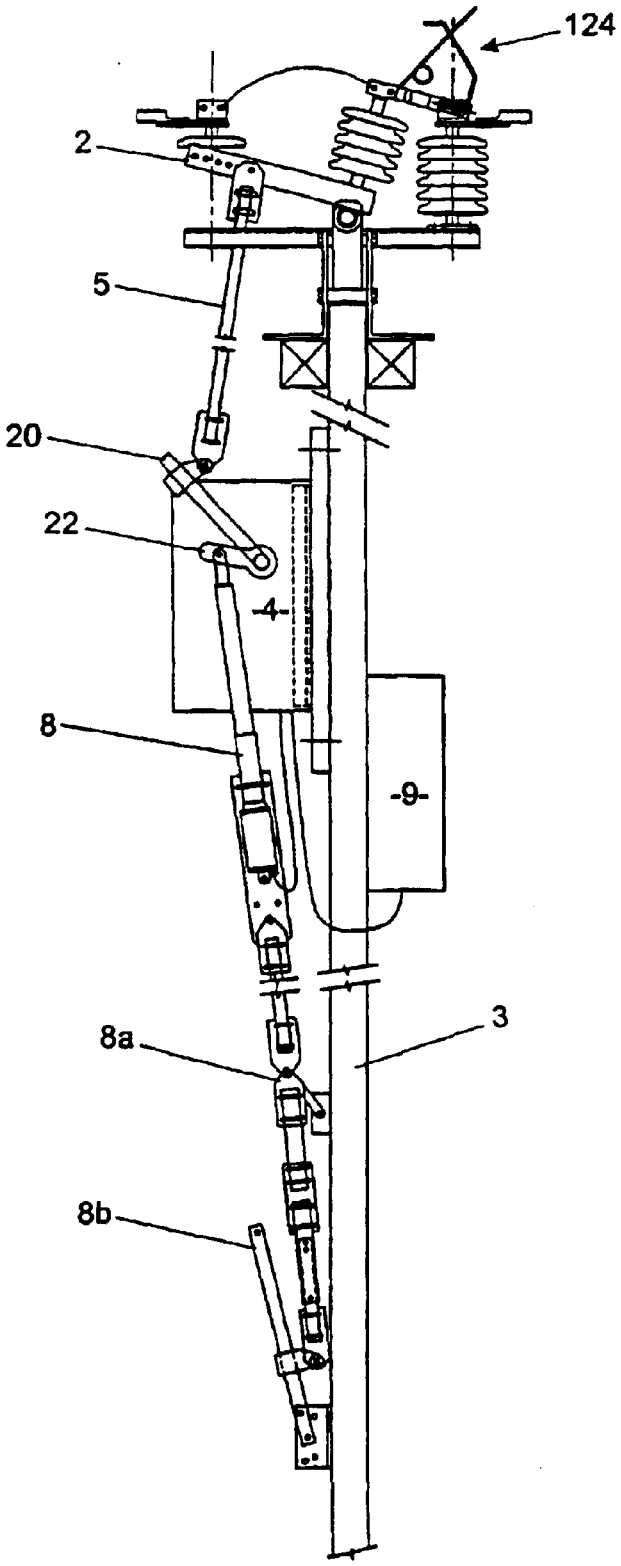

FIGURE 2a
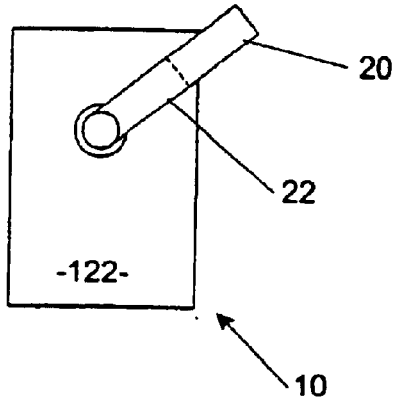
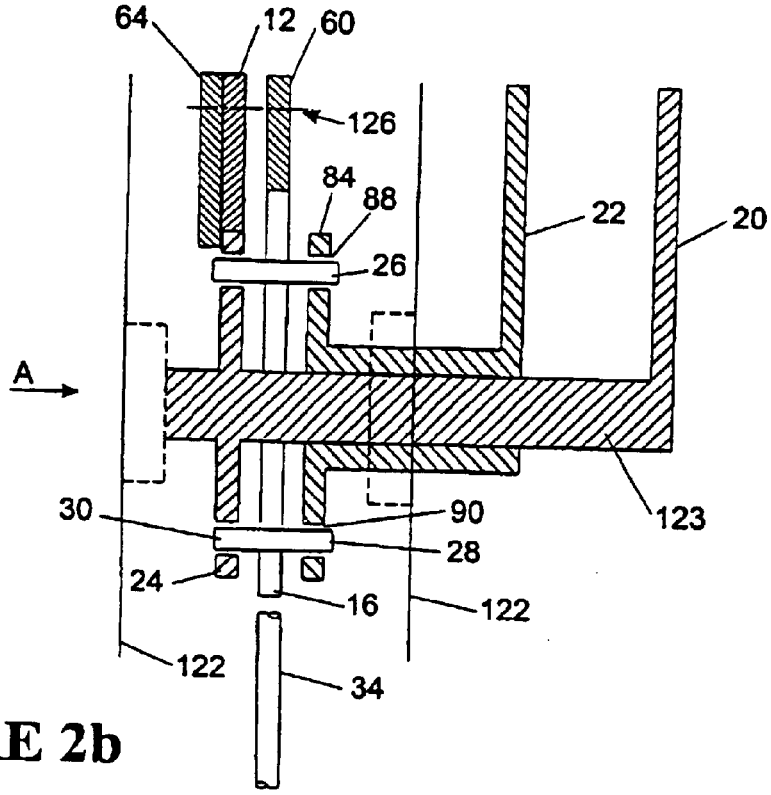
FIGURE 2b

FIGURE 4a
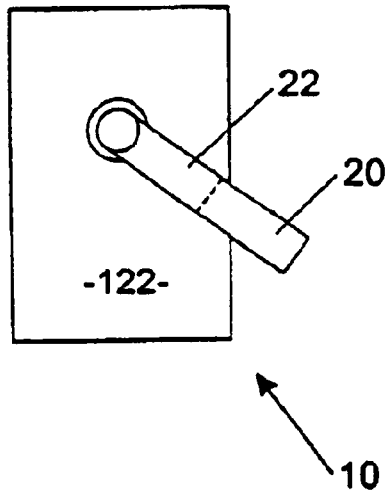
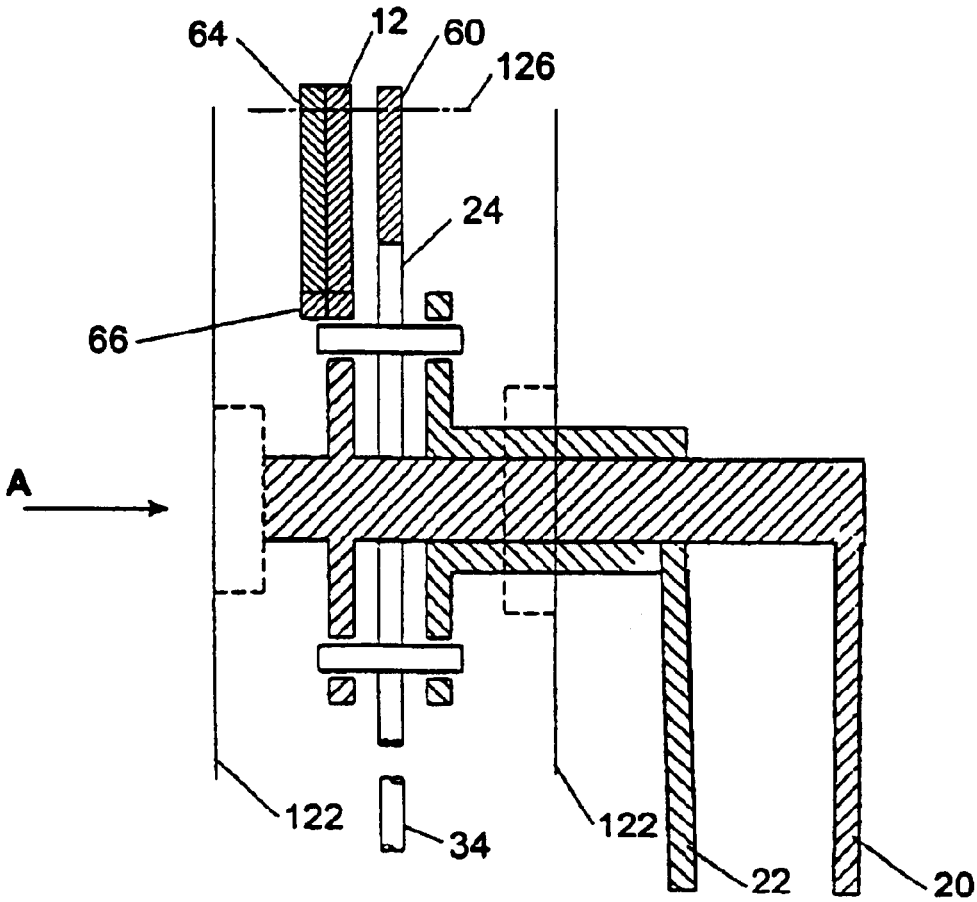
FIGURE 4b

FIGURE 5a
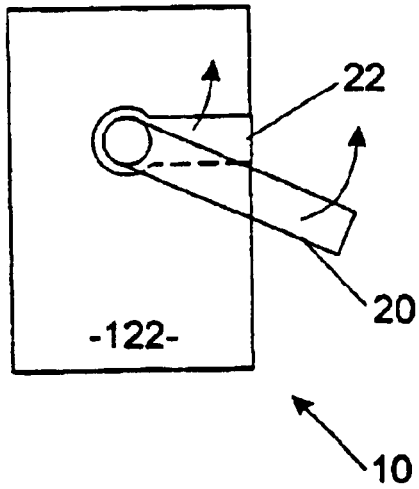
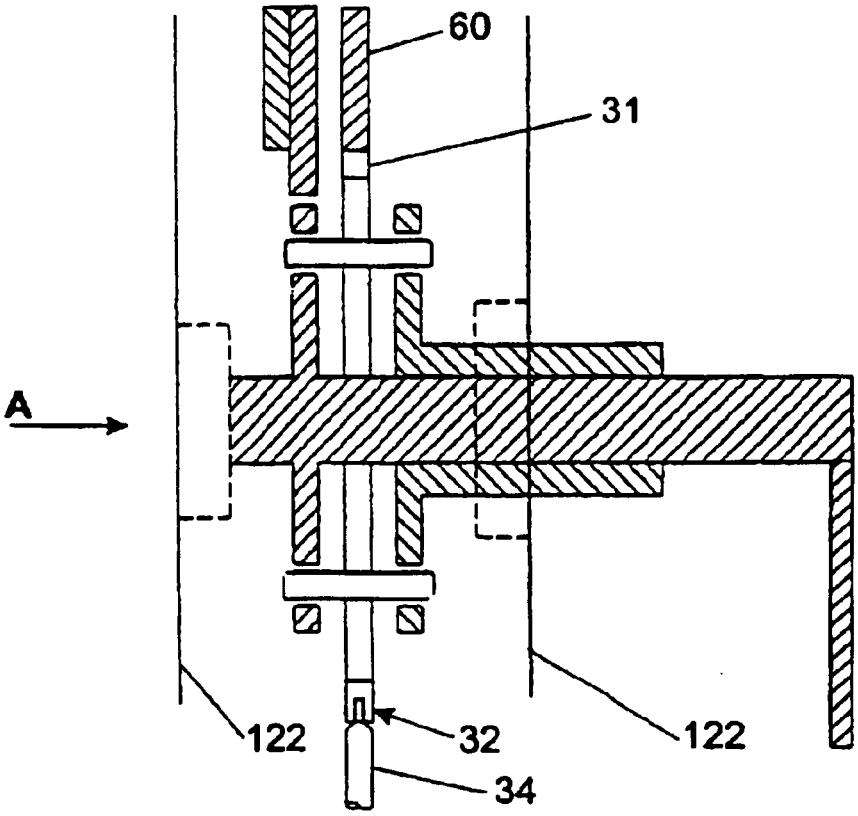
FIGURE 5b

SWITCH ACTUATOR

FIELD OF THE INVENTION

This invention relates to an actuator for high voltage air break electrical switches.

BACKGROUND OF THE INVENTION

Prior art air break switches are relatively large switches which require significant force to operate. Such switches are usually mounted on top of power poles and are designed to immediately break the power supply along an overhead high voltage distribution line or number of lines. Present air break switches are activated by manually operated handles. These handles are located at the base of a power pole to which access is only available to authorized maintenance crews. Prior art air break switch actuators usually comprise a lever mechanism biased to open or close a switch and to hold the switch in the open or closed position. The biasing action is normally due to a powerful spring under compression between two points corresponding to the switch's open or closed positions. The spring applies force in either direction away from a position between the open and close positions to the lever operating the switch which is also held in the open or closed position by the force of the spring. This introduces certain problems mainly that when the actuator is driven in a reverse direction, the spring pressure is relieved from the air break switch for the time that the spring travels to a changeover point. At the changeover point the spring commences to open or close the switch by applying force in the relevant direction. The problem is when spring force which is holding the switch closed is removed the switch contacts for this brief period are only held together by gravity with the potential for arcing should they commence to separate due to some external force or pressure. Importantly, the force required to open a switch is greater than the force required to close a switch. As a result, actuators therefore are limited to springs which are large enough to provide enough force to open the switch. It is the inventor's observation that prior art actuators do not have the ability to vary the spring force as required to open or close the switch so that more compact and springs which apply less force to the switch mechanism can be used. In addition, as prior art actuators have an exposed sliding slot mechanism, they are prone to be vandalised and can be affected by adverse weather conditions such as the mechanism icing up, being corroded by salt in a marine environment and/or jamming due to the nesting activities of birds and bird droppings.

Utilising existing ball screw linear drives and associated electronics, it is now possible to operate air break switch actuators remotely by means of radio control. This negates the necessity for maintenance crew have to travel to a fault site in order to operate the air break switch to disconnect power along the relevant faulty line or lines. The switch can be actuated well in advance to limit or prevent further damage to the grid and to isolate faulty sections of line. The introduction of remote control mechanisms, however requires efficient and smooth operation of the actuator apparatus. Prior art switch actuators which may be affected by weather, vandals or jammed by other factors present a significant reliability problem in terms of remote or radio controlled operation.

It is therefore an object of the present invention to alleviate to some degree some of the problems associated with prior art air break switch actuators or to at least provide the public with a useful choice.

SUMMARY OF THE INVENTION

In a first aspect the present invention consist in an air break switch actuator comprising or including:

a structure providing means to locate in position, a switch actuating means adapted to move between a first and a second position corresponding to an open or a closed position, or vice versa, of a switch, operating means, operable manually and/or by a drive unit, a connection means connecting the operating means with the switch actuation means to positively displace the switch actuation means at least during part of the movement of the operating means biasing means applying, directly or indirectly at least during part of the movement of the switch between the first and second positions, a biasing force to urge the actuating means to the first or the second position.

Preferably the biasing means acts directly or indirectly at least during part of the movement of the switch between the first and second positions, to bias the switch actuating means away from a snap through region of movement thereof, in a direction towards the first or second position.

Preferably said biasing means acts on the connection means to bias the connection means via a linkage means, there being provided as part of said linkage means a trigger means to move the direction of the biasing force applied by the biasing means to the connection member dependent on the position of said connection.

Preferably said trigger means is engaged to the linkage mechanism and becomes operative, to move the direction of the biasing force when said connection means is at the snap through region, by being displaced by the movement of said connection means.

Preferably said linkage means is configured such that said trigger is actuated by the movement of said connection means to advance the snap though point to occur earlier in said snap though region.

Preferably said switch actuating means comprises a switch lever rotatably movable about lever axis between two positions corresponding to the open and closed positions of said switch.

Preferably said operating means comprises an operating lever rotatably movable about said lever axis between two positions corresponding to the open and closed positions of said switch.

Preferably said connection means is a plate which is rotatable about said lever axis and includes a connection member for engagement and to provide positive displacement by the operating means, to the switch actuating means at least during part of the movement of the operating means.

Preferably said operating means includes an operating plate directly connected to and for rotation by said operating lever, said operating plate having at least one slot, concentric with said lever axis, with which said connection member of said connection means is engaged at least during rotation of said operating means towards said snap through point, said connection means is rotatably displaced by the movement of said operating plate up to the point at which snap through occurs.

Preferably said switch actuation means includes a switch plate directly connected to said switch lever to operate the rotation of said switch lever respondent to the displacement thereof by the connection member.

Preferably said switch plate includes as least one slot, concentric with said lever axis, with which the said connection member of said connection means is engaged to displace said switch plate at least through and beyond said snap though point.

Preferably said at least one slot of said switch plate is of identical shape to the at least one slot of said operating plate.

Preferably said at least one slot of said operating plate, when said connection plate is at its extremes of rotation, is in alignment with the at least one slot of said switch plate.

Preferably said connection plate is intermediate of the operating plate switch plate, said connection member being a transverse pin extending into the slots of the connection plate.

Preferably said operating plate has two slots and said switch plate has two slots, said connection plate providing two connection members, one for each of the pairs of slots.

Preferably said linkage means includes a connection rod acting directly on and at a circumferential point of the connection plate, said connection rod connected to a crank pivoted about a fulcrum provided by said trigger arm, wherein said biasing means is provided to act on said crank to bias said connection rod toward said connection plate.

Preferably said trigger arm is pivotably located to said structure providing means to displace said fulcrum with a component of movement in a direction tangential to the arc of movement of the connection point of the connection rod to the connection plate.

Preferably a locking means is movably mounted from said structure providing means to selectively lock the switch plate from rotating when said switch is in either the first or the second position.

Preferably said locking means is at least one pawl member pivotable with respect o the structure providing means to move between a retracted condition and a locking position, wherein in a locking position it is able, when aligned with, to engage with a complementary shaped notch of catch of said switch plate.

Preferably said locking means is movable from said engaged condition to said retracted condition, respondent to the rotational position of said connection plate, by a cam follower which follows the contour of an appropriately shaped cammed surface of said connection plate.

Preferably said locking means is movable from said retracted condition to said engaged condition, respondent to the rotational position of said connection plate, by a cam follower which is biased towards and to follow the contour of an appropriately shaped cammed surface of said connection plate.

In a second aspect the present invention consists in a switch actuator to move a switch between a first and second position corresponding to an open and closed position of the switch, said actuator comprising or including:

a first rotatable member in mechanical connection with and to move said switch between said open and closed position by the rotation of said rotatable member about an axis, a second rotatable member in mechanical connection with an actuator, and rotatable about said axis a connection member rotatable about said pivot axis, said connection member biased by a biasing means for rotation about said pivot axis in a toggle manner between a first angular position and a second angular position, said connection member providing a mechanical connection means to locate (a) against a fixed point of, and be displaced by, said second rotatable means at least during the rotation of the connection member by the second rotation means towards the point of toggle of the connection means, and (b) against a fixed point of and to thereby displace, the first rotatable member at least during rotation of said connection member passed said point of toggle.

Preferably said fixed points of said first and second rotatable members are the distal ends of at least one slot provided in each of said first and second rotatable members, said mechanical connection means extending into each of said slots.

Preferably said biasing means acts on the connection member to bias the connection member via a linkage means, there being provided as part of said linkage means a trigger means to move the direction of the biasing force applied by the biasing means to the connection member dependent on the angular position of said connection member.

Preferably said trigger means is engaged to the linkage member and becomes operative to move the direction of the biasing force, when said connection member approaches a point of rotation nearing the toggle point, by being triggered by the movement of said connection member.

Preferably said linkage means is configured such that said trigger is actuated by the movement of said connection member to advance the toggle point to occur earlier in the rotation of said connection member.

In a further aspect the present invention consists in the use of an actuator as hereinbefore described for the control of an air brake switch between an open and closed position of the air brake switch.

In still a further aspect the present invention consist in an air break switch actuator to including in combination:

a housing adapted to enclose in position, a switch actuating means adapted to move between a first and a second position corresponding to an open or a closed position, or vice versa, of a switch, operating means to operate said actuating means, the operating means manually operable and/or driven by a linear drive unit, releasable locking means adapted to lock the actuating means in either the first or the second position, biasing means adapted to apply a biasing force to urge the actuating means to either the first or the second position, linkage means coupling the operating means with the locking means and the biasing means, the linkage means adapted to change the direction and strength of the biasing force between said first and second portions, wherein in operation, the operating means disengages the locking means and causes the actuating means to move from the first to the second position and at the same time overcoming the biasing force of the biasing means; the linkage means changing the direction and strength of the biasing force to urge the actuating means from the first to the second position, the locking means then re-engaging and locking the actuating means in the second position, the operation repeatable between first and second positions as required.

Preferably the actuating means comprises a switch lever movable between two positions and joined to a slotted switch plate, the switch lever connected by connecting rods or other means to open or close the air break switch.

Preferably the operating means includes a manually or motor driven crank, the crank connected to a motor plate having slots which at least in one position is in corresponding alignment with the slots of the switch plate, the motor plate engaging the switch plate by means of a spring plate intermediate the motor plate and the switch plate wherein the spring plate has transverse pins engaging the slots of the motor and switch plates, the motor plate, spring plate and switch plate in coaxial alignment and rotatable about an axial shaft. Preferably the linear drive unit is a linear electrical actuator with a mechanical clutch at both ends of travel to prevent damage to the actuator in the event of jamming or failure of any of the actuator's components.

Such an electrical linear actuator enables the spring actuator to be remotely operated.

Preferably the locking means comprises one or more pawl members pivotal about an axial member at one end and having one or more sprags engageable with notches in the switch plate. The sprags of the pawl members are disengageable from the notches by means of a cam action of the springplate whereby one or more cam lobes on the spring plate in contact with one or more cam following portions of the pawl members pivots the pawl members away from the switch plate.

The biasing means is preferably a spring under compression operating through a lever connected by an extension arm to a lug on the spring plate.

The crank operating through the linkage members compresses the spring and cause the spring plate to rotate from the first to the second position until the direction of the spring's force is changed by the linkage members so that the compression of the spring is released to drive the spring plate and the switch plate to the second position. On reaching the second position the pawl members are re-engaged with the switch plate thereby locking the switch plate in the second position.

To return the switch plate to the first position, the order of the operation is reversed by the crank to change the rotation of the spring plate in the direction of the first position wherein the pawl members are disengaged from the switch plate by the cam action of the spring plate. The spring is recompressed until the direction of the spring force is changed by the linkages member wherein the spring is again released from its compressed state to return the spring plate and the switch plate to the first position.

Preferably the biasing means includes adjustment means for adjusting the tension of the spring.

Preferably the engagement of the sprags of the pawl members with the notches of the switch plate is under spring tension and is adjustable.

BRIEF DESCRIPTIONS OF THE DRAWINGS

Figure 2:
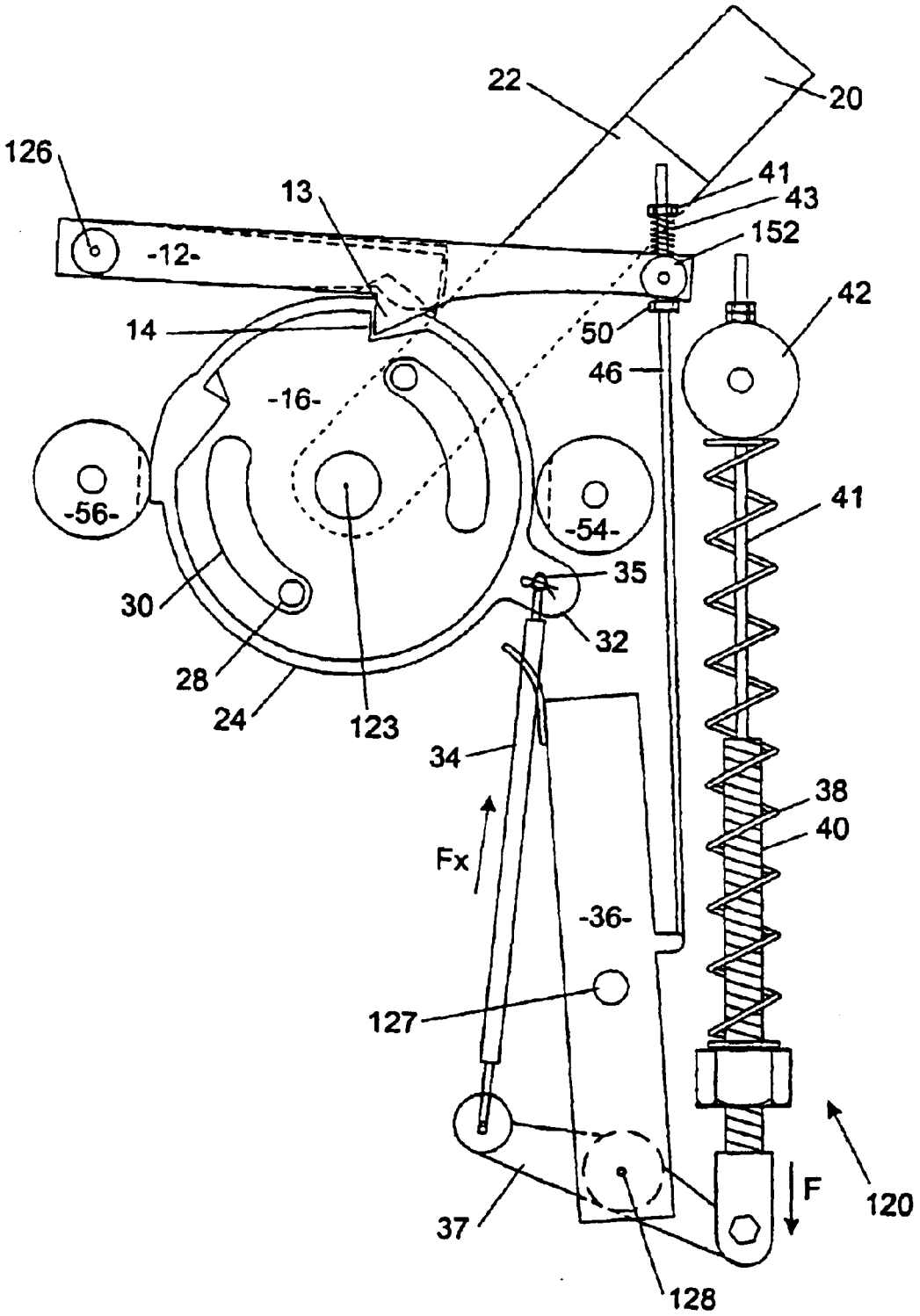
Figure 4:
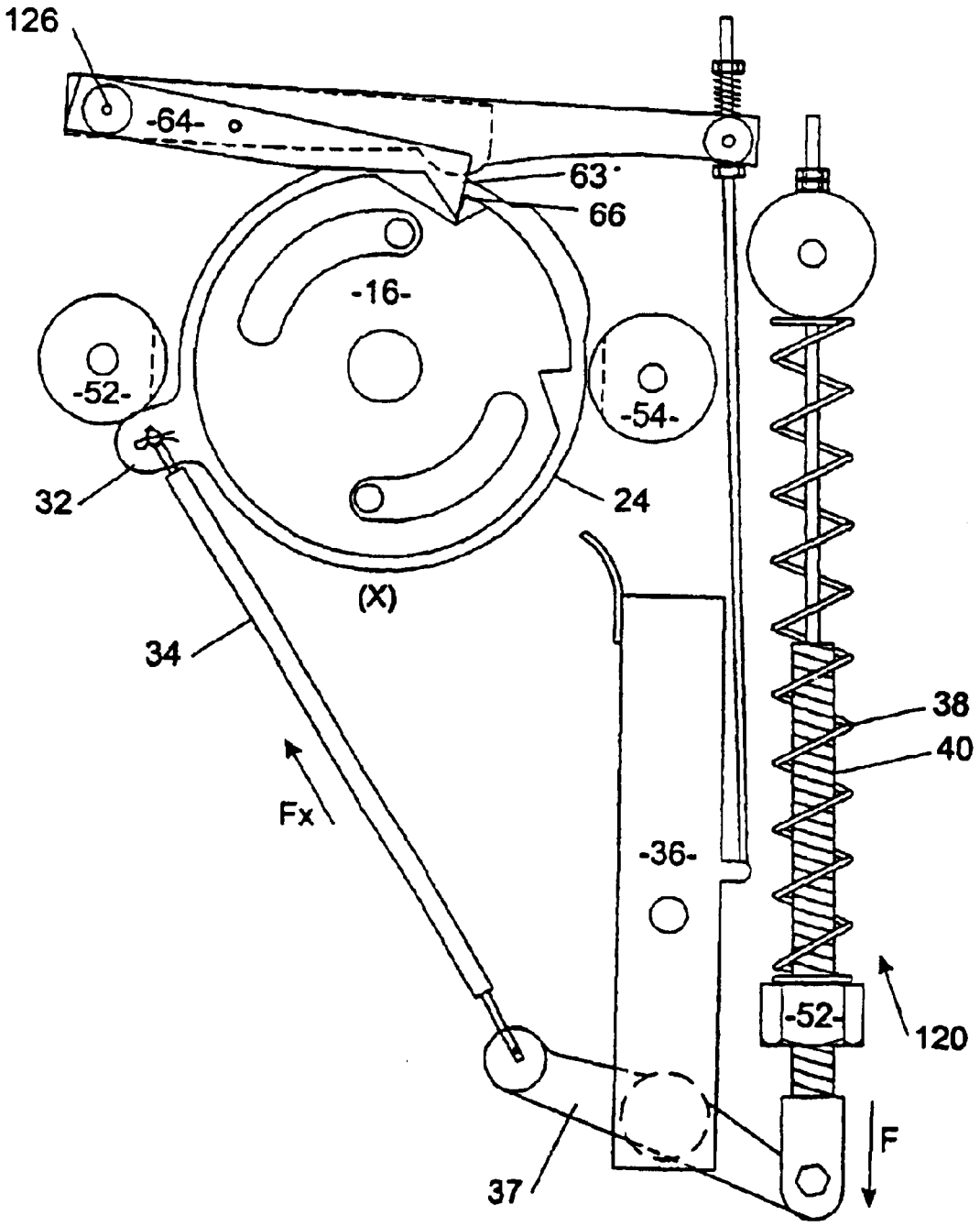
Figure 5:
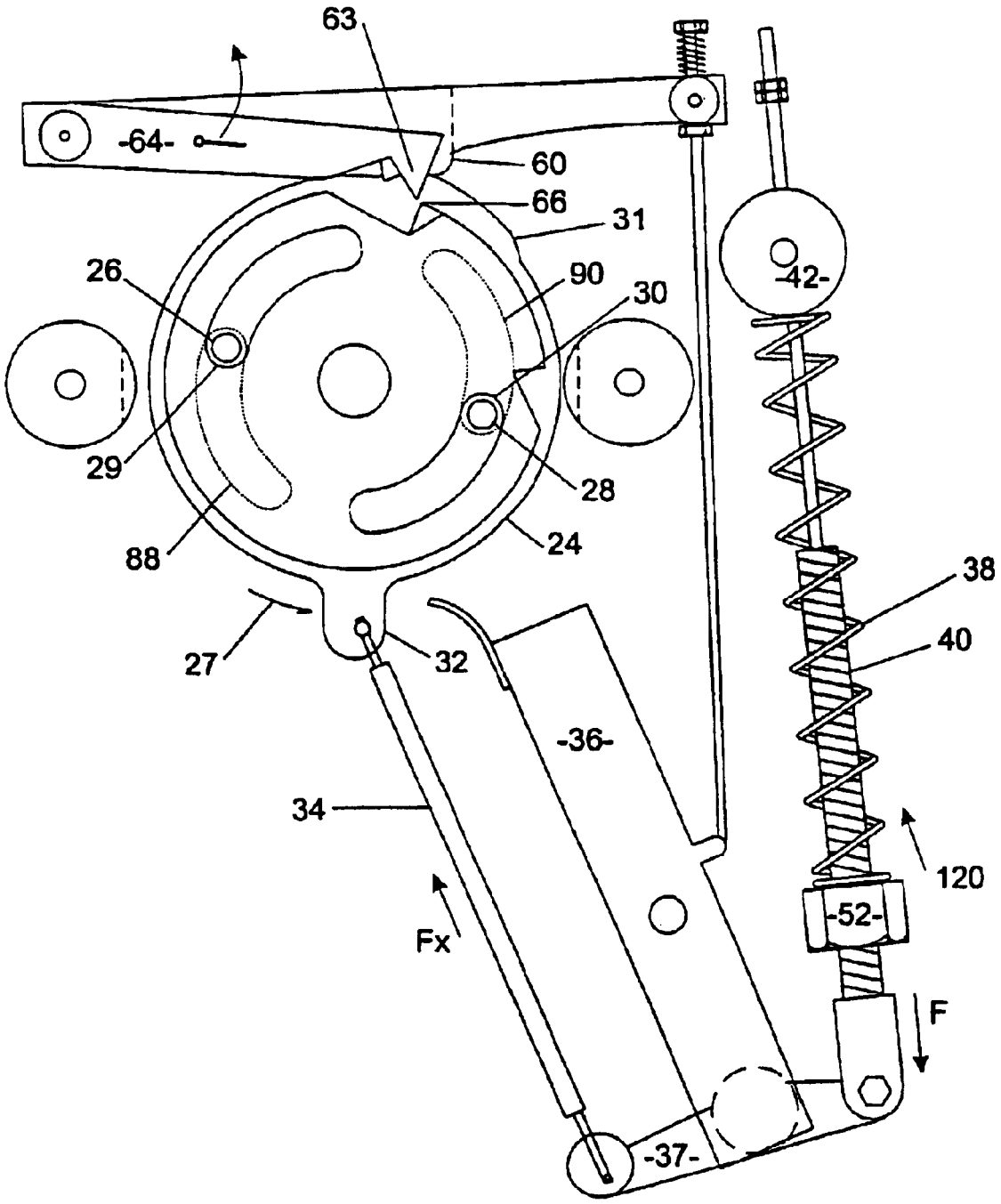
Figure 12:
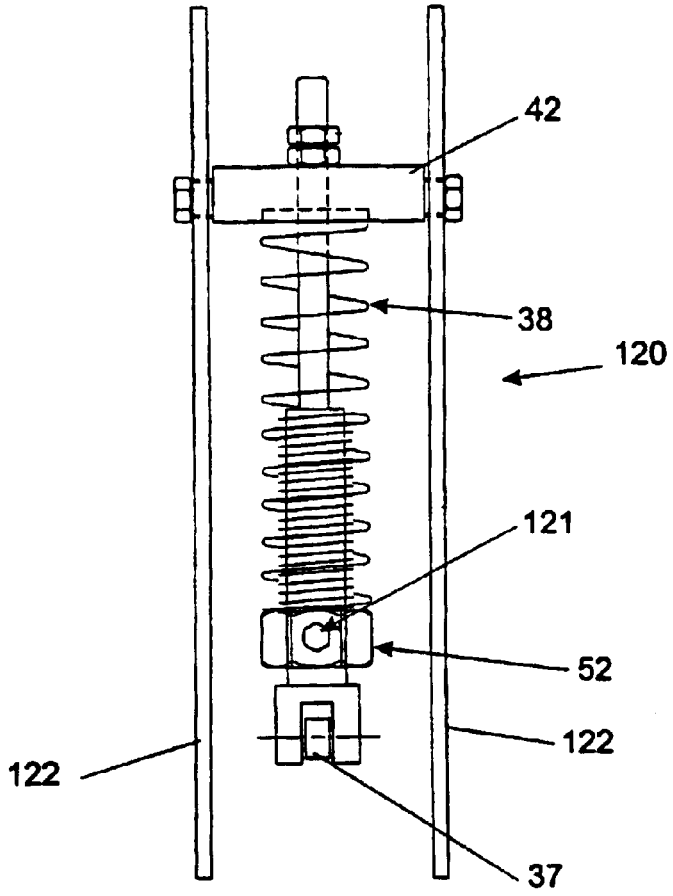
Figure 6:
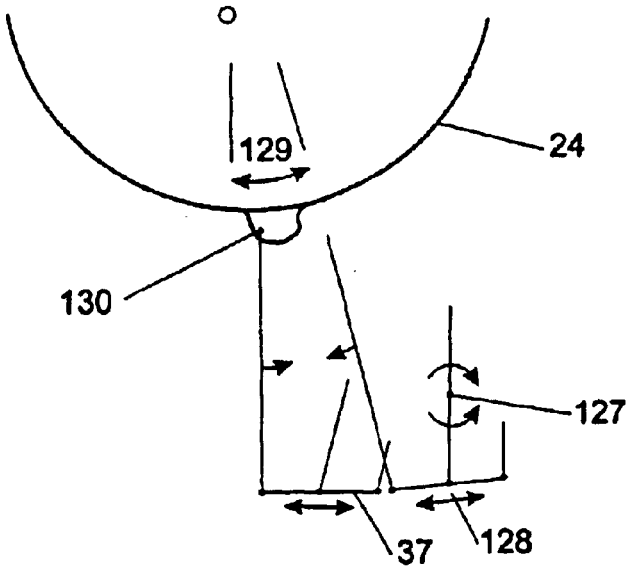
Figure 7:
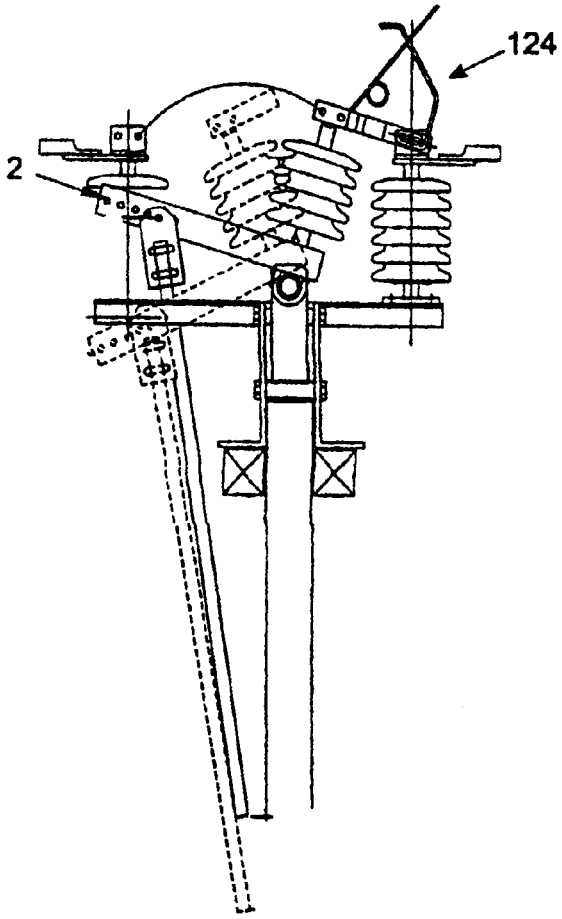
Figure 8:
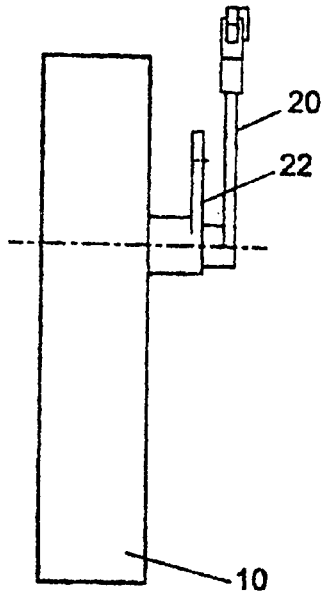
Figure 9:
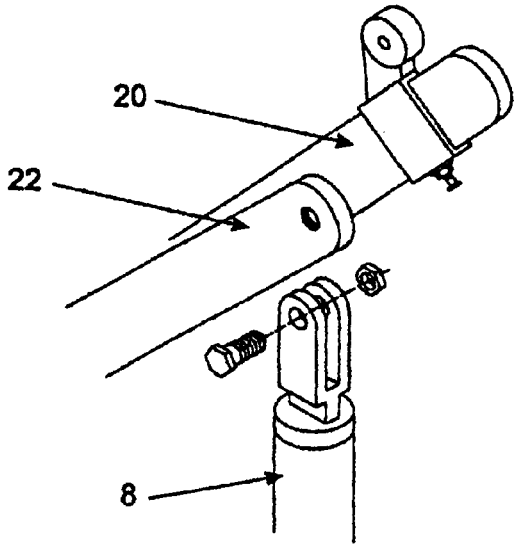
Figure 10:
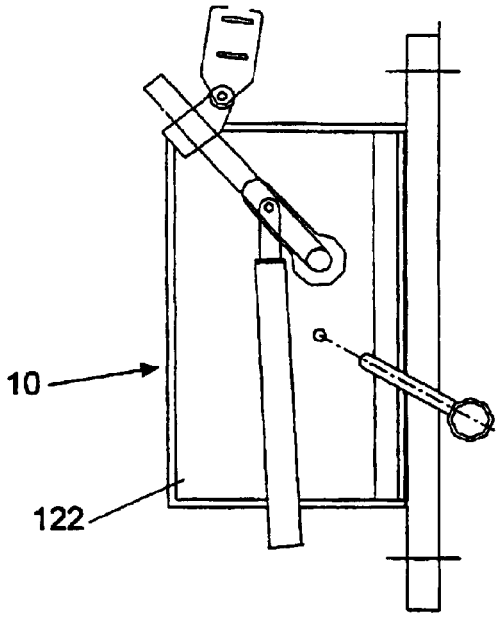
Figure 11:
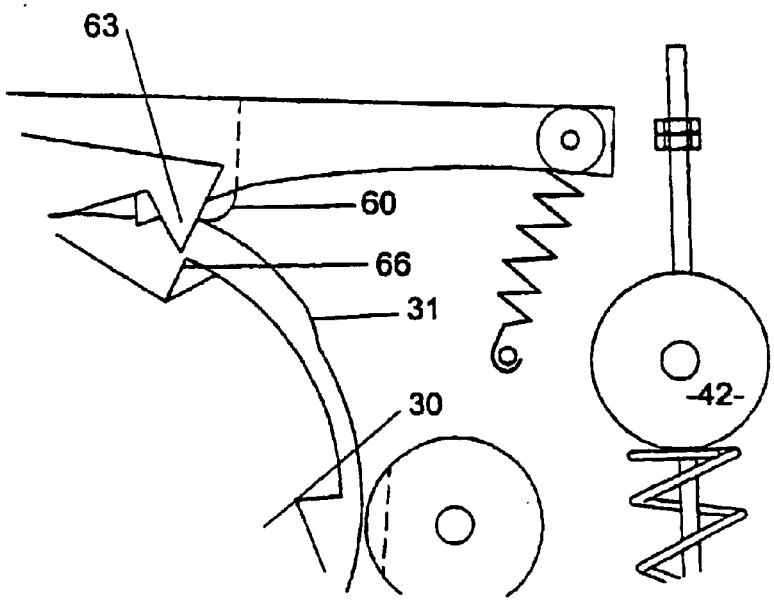

In order that this invention may be more readily understood and put into practical effect, reference will now be made to the accompanying drawings which illustrate a preferred embodiment of the invention and wherein:

FIG. 1 is an illustration of the air break switch actuator in situ according to the invention, FIGS. 2–5 show the action of the air break switch actuator of FIG. 1, viewed in direction A of FIGS. 2*b*–5*b* respectively, FIGS. 2*a*–5*a* show the relative positions of the switch lever and the motor lever corresponding to FIGS. 2–5, FIGS. 2*b*–5*b* shows a transverse section of part of the actuating means according to the invention, FIG. 6 is an illustrative view of the mechanism showing triggering of the snap through of the spring plate, FIG. 7 is a view of an air brakes in a closed condition and in phantom in an open condition, FIG. 8 is an end view of the air brake actuator, FIG. 9 is a perspective view of part of the present invention at the regions of linkage arm connections to the switch lever and motor lever, FIG. 10 is a side view of the air brake switch actuator and portions of the linkage arms extending from the switch lever and motor lever, wherein also illustrated is a lock out pin for the optional and selective use to render the present invention inoperative, FIG. 11 shows an alternative to the pawl biasing arrangement, and FIG. 12 illustrates in detail and in an end view when compared to the view as shown for example in FIG. 2, of the biasing assembly 120.

DETAILED DESCRIPTION OF THE DRAWINGS

Referring to FIG. 1 there is shown an air break switch 124 actuated by an operating lever 2 located on a power pole 3. The switch is connected to the air break switch actuator 4 according to this invention by means of connecting rod 5. The connecting to the switch lever 20 of the actuator. The motor lever 22 is connected to a linear actor drive unit 8 which has a manual operating mechanism comprising an adjustable extension 8*a* coupled to a lever mechanism 8*b*. Preferably the drive unit is a linear electrical actuator with a mechanical clutch at both ends of travel to prevent damage to the actuator in the event of jamming or failure of any of the actuator's components. Such an electrical linear actuator enables the switch spring actuator to be remotely operated. With reference to FIG. 1, the actuator is shown with an optional remote control facility 9 to enable radio 5 controlled activation of the actuator.

The air brake switch actuator 4 is mounted on a power pole 3 and connects to the operating lever 2 of the air brake switch 124. The air brake switch actuator of the present invention allows the movement of the air brake switch between a first and second condition (being conditions to allow power to be conducted and to be broken at the switch).

The present invention moves the air brake switch by the use of an over centre toggle spring arrangement. A biasing means such as a spring is compressed until the mechanism of the present invention reaches a point where then the energy of the biasing means is utilised in rapidly moving the air brake switch to the other condition.

In the most preferred form, the air brake switch actuator is provided in a housing 10. The structural providing portions of the components of the present invention are preferably two side walls 122 between and from which the components of the air brake switch actuator are provided.

Prior to detailing the operation of the invention, reference is first made to FIGS. 2, 2*a* and 2*b* where there is shown components of an air break switch actuator according to the invention. In FIG. 2 one side of the housing has been removed. In this position of the components of the device, the switch (not shown) is in the closed position. The switch lever 20 is connected to the switch plate 16 (herein also referred to as a first rotatable member) and the motor lever 22 is connected to the motor plate 84 (herein also referred to as a second rotatable member). The motor plate 84, is of a substantially similar shape and has substantially similar features as that of the switch plate 16. Indeed in the conditions as shown in FIGS. 2 and 4, the slots 29, 30 of the switch plate 16 are in substantial alignment with correspondingly shaped slots 88, 90 of the motor plate 84.

A spring plate 24 (also herein referred to as the connection member) is located to rotate about the same axis of rotation as the motor and switch plates. Its rotation is of a snap through or toggle like manner.

Both the spring plate 24 and motor plate 84 and switch plate 16 rotate about a pivot axis common with the axis of the central shaft 123.

The spring plate 24 which preferably lies adjacent the switch plate 16 engages to displace the switch plate by means of at least one pin, and preferably two pins 26, 28 in the slots 29, 30 of the switch plate.

The spring plate 24 itself, is displaced (prior to reaching the over centre snap through point) by the motor plate 84 by means of the pins 26, 28 which also extend within the slots 88, 90 of the motor plate.

Referring to FIG. 2*b* there is shown the switch lever 20 which is in coaxial relation with motor lever 22, motor plate 84, switch plate 16 and spring plate 100. The motor plate 84 and the switch plate 16 are connected by means of their respective slots 88, 90 and 29, 30 via the transverse pins 26, 28 of the spring plate 24. The spring plate is preferably located between the switch plate and the motor plate.

Movement of the spring plate is limited by the lug 32 coming into contact with stoppers 54, 56. The stoppers may also be provided in a form similar to the spacer member 42 as shown in FIG. 12, to span between the side walls 122 of the housing.

The spring plate is connected by a linkage mechanism to a biasing assembly 120 which acts to move the plate in a snap through manner. This connection is preferably achieved by a lug 32 connected by extension arm 34 and crank 37. The crank is also connected to a trigger mechanism which includes lever 36. The lever 36 is connected to the housing at a stationary pivot point 127. This stationary pivot point provides the pivot point about which the lever 36 rotates. The stationary pivot point 127 is stationary relative to the axis of rotation of the spring plate, motor plate and switch plate. At or towards one distal end of the lever 36, is a displaceable pivot point or fulcrum 128 at which the crank 37 is pivotally located. The crank 37 is connected to the biasing assembly 120, in a manner such that the crank will operate to deliver a force in direction $F_x$ along the extension arm 34 in a direction towards the spring plate 24. The biasing assembly provides the speed of operation of the air switch. The speed of operation is adjustable by making adjustments to the biasing assembly 120. The biasing assembly preferably includes a biasing means such as a compression spring 38. This biasing means is able to have its biasing force in the direction indicated by "F", adjusted by for example a nut 52 provided on a threaded member 40. In the most preferred form the biasing means 38 is a helical spring. By reducing the length of the spring by rotating the nut 52 upwardly along the threaded member, the speed of operation of the air switch is increased. With reference to FIG. 12, the biasing assembly 120 is held stationary at the position where the spacer member 42 is provided. This spacer member 42 is preferably bolted to and extends between the side wall plates 122 of the housing of the air brake switch actuator of the present invention. The nut 52 may include a locking bolt 121 to lock the nut in the desired position along the threaded member 40. Counter clockwise rotation of crank 37 compresses spring 38. The threaded member has a portion 41 which is slidably and pivotally located with and through spacer member 42.

A locking mechanism may also be provided to lock the air brake switch in its open and closed condition. This is preferably achieved by at least one and preferably two pawl members.

The pawl member 12 is pivotably secured at pivot 126 similarly like the spacer member 42 substantially between the side walls 122 of the housing to thereby locate a pivot point for the pawl member. This pivot point 126 may also provides the pivot point for the pawl member 64 and a cam following section 60.

The pawl member is connected to lever 36 by means of an extension rod 46 having tension adjustment means comprising lock nut 50, adjusting nut 41 and spring 43. The extension rod 46 is pivotally and slidably connected with respect to a connection point 152.

FIG. 11 shows an alternative to the provision of a rod 47 wherein merely a spring is attached to a structural part of the enclosure of the present invention to provide a biasing means to the pawls and cam follower in a direction towards the plates.

Both pawls 12 and 64 act on the switch plate 16. In the configuration as shown, one of the pawls 12 and 64 act to lock the switch plate at one extreme of rotation (e.g. when the air brake switch is closed) and the other of the said pawls acts to lock the switch plate at the other extreme of rotation (e.g. when the air brake switch is in an open condition). See for example FIGS. 2 and 4 of the extreme positions of rotation of the switch plate.

With reference to FIG. 4*b*, the pawl 64 is engaged with the notch or lip 66 of the switch plate to thereby prevent rotation of the switch plate (with reference to FIG. 4) in an anti clockwise direction.

With reference to FIG. 2, the pawl 12 is engaged with the notch 14 of the switch plate to thereby lock the switch plate from rotating in a clockwise direction.

Whilst the locking of the switch plate could be achieved by a single pawl to be located within an appropriately shaped recess in the spring plate, it has been found that a ratchet shaped pawl to act in only one direction of locking on the switch plate, reduces any problems of natural movement occurring to the present invention (as a result for example the movement in the power pole or pressure being applied to the switch e.g. icing) which may jam the operation of the device of the present invention. A ratchet shaped pawl will allow for more easy retraction of the pawl from the notch but such ratchet shaped pawl requires for there to be two pawls one for locking the rotation in each direction of the switch plate.

The spring plate has raised portions or cam lobe sections 31 to effect a cam like action on the pawl member 12.

The cam following portion 60 follows the cam surface on the perimeter of the spring plate 24. An interconnection exists between the pawls and the cam following section 60 to thereby control the engagement and disengagement of the pawls with the switch plate. Referring now to the operation of the invention, we firstly refer to FIG. 2 wherein the air brake switch is in a closed condition as a result of the switch lever 20 being in an upper most condition. In this condition the motor lever 22 is also in an upper most condition.

The switch is locked in this position by the pawl member 12 shown with the sprag 13 of the pawl engaging notch 14 in the switch plate 16 thereby preventing the switch plate from rotating in the clockwise direction. Whilst the force of the biasing assembly on the spring plate and hence when in the conditions as shown in FIGS. 2 and 4, on the switch plate could be sufficient to ensure that the switch plate remains in that position, sometimes gravity or other external forces which may be acting on the operation, lever or air brake switch may allow for the switch plate to move. This is why the preferred provision of the pawl members is included in the present invention. When at the extremes of rotation, the switch plate is actually locked and prevented from rotation by the pawl members engaging with the pawl engaging notches 14, 66.

FIG. 2*a* shows the relative positions of the switch lever 20 and motor lever 22 in the condition of FIG. 2.

Once a rotation is provided to the motor lever 22 as a result of connection with an actuator such as a handle or the motor connection 8 in a downward direction, the motor plate 84 will rotate in a clockwise direction with reference to FIG. 2. As the pins 26, 28 are at the anti clockwise extreme most location of the slots 88, 90 of the motor plate, when the motor plate is rotated in a clockwise direction the pins and hence the spring plate also rotate in a clockwise direction. Preferably at least up until the point where the toggle mechanism of the present invention will snap through the toggle point the pawl 12 is engaged with the notch 14 of the switch plate 16.

Figure 3:
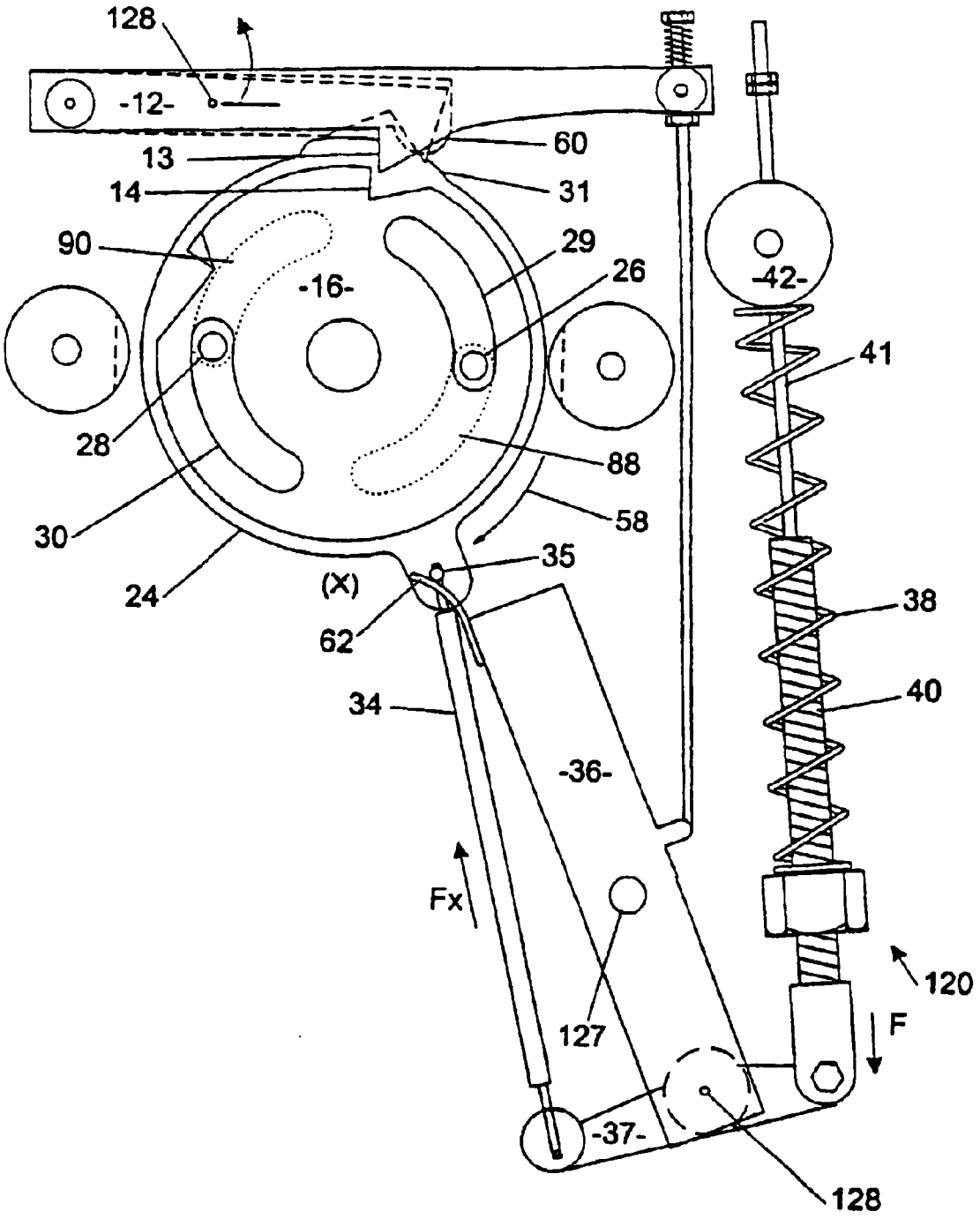

FIG. 3 shows clockwise rotation 58 of the spring plate 24 and the switch plate 16 towards a switch open position. By the further counter clockwise rotation of the spring plate, the pawl member 12 becomes disengaged from the notch 14 as a result of the cam lobe 31 of the spring plate coming into contact with the cam following portion 60 and lifting the pawl member 12. Between the cam follower and the pawl member 12 is an interconnection by for example a pin and slot arrangement at 128 which, will lift the pawl member 12 to being disengaged with the pawl engaging notch 14. The switch plate is then free to move in a clockwise direction. This clockwise rotation will occur when the pins 26, 28 of the spring plate engage the ends of the slots 29, 30 of the switch plate. Rotation of crank 37 caused by the extension arm 34, causes spring 38 to be compressed as the spring plate travels towards a position marked, "x".

Figure 3A:
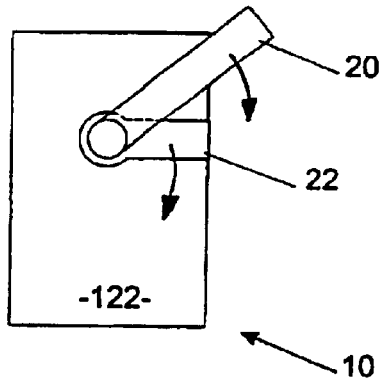

FIG. 3*a* shows the relative positions of the switch lever 20 and motor lever 22 for this situation.

Figure 3B:
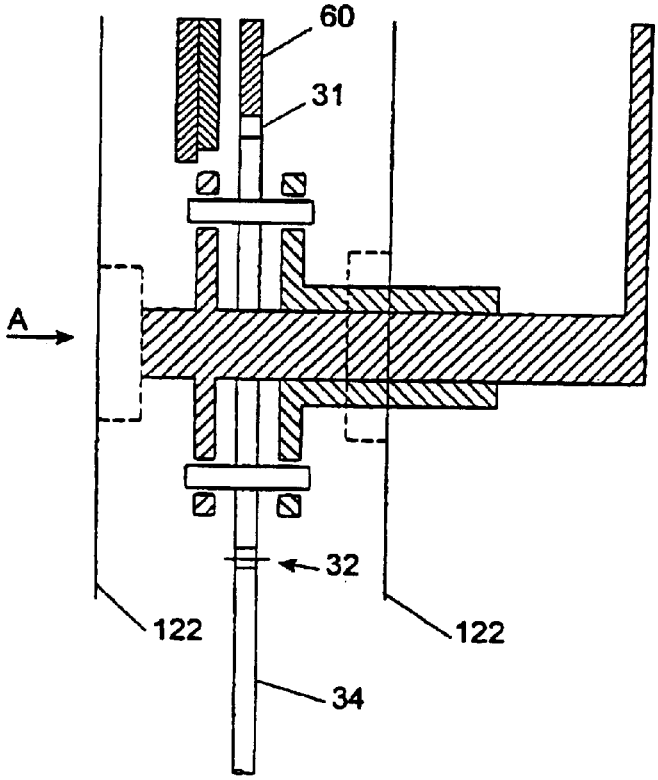

With reference to FIG. 3*b*, it is to be noticed that the positions of the pins and the slots is not accurately reflected as the pins have rotated clockwise from the position as shown in FIGS. 2 and 2*b*.

The trigger mechanism of the linkage means is provided by the lever 36. The lever 36 is pivoted about pivot 127 and its movement is dependent on the position of rotation of the switch plate 24. A finger 62 provided on the lever 36 on the other side of the axis of rotation to where the fulcrum of the crank 37 is provided on the lever, is positioned to engage with a fixed portion on the spring plate such as a spring plate lug or pin 35 or the like. As the switch plate approaches the snap through point (which would be a fixed point if the fulcrum 128 of the crank was provided as a stationary pivot point) the finger 62 makes contact with the spring plate and is thereby displaced. This displacement causes the lever 36 to rotate about the pivot 27 and to thereby displace the fulcrum 128 in a direction which advances the point of snap through. With reference to FIG. 6, it can be seen that when the fulcrum point 128 has been displaced, that the angle of force $F_x$, is changed in respect of the spring plate. As the snap through point of the spring plate is dependent on the angle at which the biasing force is applied along the extension arm 34, the movement of the direction of the force will advance the point of snap through in both the clockwise and anti clockwise rotation of the spring plate. Therefore effectively there is a snap through region 129 which is an arc of rotation of the switch plate defined by the distance of displacement of the fulcrum 128 resulting in the movement of the angle of force applied by the extension arm 34. The trigger mechanism provides a component of displacement of the fulcrum 128 in a direction which has a component of movement at least tangential to the switch plate.

FIG. 4 shows the spring plate 24 has rotated passed the snap through wherein the spring 38 has been allowed to decompress thereby urging the spring plate via extension arm 34 to rotate in the clockwise direction until lug 32 is in contact with stopper 56. The spring plate in this position causes the switch plate 16 and hence the switch lever to rotate clockwise and to open the switch.

The sprag 63 of pawl member 64 is shown engaging the second notch 66 of the switch plate thereby locking the switch in the open position. FIG. 4*b* shows the relative positions of the motor lever 22 and the switch lever 20 for this position In moving from the condition as shown in FIG. 3 to the condition as shown in FIG. 4, it can be seen in FIG. 3 that the motor plate slots 88, 90 are in a position which when the switch plate is moved by the spring plate through the snap through point will result in the slots of the switch plate to be in a substantially similar location as the slots of a motor plate. That is, the slots of the motor plate are in a position that will allow for the pins 26, 28 to rapidly displace clockwise and hence the drag switch plate with it to move the switch to the open condition.

The appropriate selection of the shape and lengths of the slots will hence allow for a snap through action to occur of the spring plate which then carries the switch plate with it, without there being any force applied on the motor plate by the biasing means (once beyond the snap through point).

FIG. 5 shows the counter rotation of the spring plate 24 in the direction of arrow 27 towards the switch closed position of FIG. 1. Cam lobe 31 of the spring plate 24 by engaging with the cam following section 60 will result in the pawl member sprag 63 of pawl member 64 disengaging from the notch 66 of the switch plate. As the spring plate rotates in the counter clockwise direction 27 towards the snap through position the spring 38 is recompressed by the action of crank 37. The spring is released once the lug has passed the snap through position so that it assumes a less decompressed state when the spring plate and the switch plate are returned to the first position as shown in FIG. 2.

Advantages of the Preferred Embodiment

The advantages of the preferred embodiment include its enclosed structure which is not exposed to either the weather or the possibility of interference by vandals. The air break switch actuator as herein above described can be used to isolate sections of high voltage power distribution networks.

The locking of the actuator in the switch open or closed position is an advantage which overcomes the possibility of arcing or partial disconnection due to the bending or warping of the power pole on which the actuator and switch are located. As previously discussed, as prior art air break switch actuators presently rely on the strength of the spring in order to close or open the switch, there is possibility that contact can be broken if the spring breaks or the power pole bends or is warped. The locking means of the invention ensures that electrical contact is maintained irrespective of the force of the spring or biasing means. The smoother operation and trigger mechanism of the present invention also allows motor drives and other screw jack means to operate air break switches efficiently and with reduced possibility of failure.

What is claimed is:

1. An air break switch actuator comprising or including:

a structure providing means to locate in position, a switch actuating means rotatable about a rotation axis between a first and a second rotational position corresponding to an open and closed position of a switch, operating means rotatable about said rotation axis and responsive in rotation to a manual and/or by a drive unit input via an operating lever of said operating means, a connection plate rotatable about said rotation axis connecting for rotation the operating means with the switch actuation means to positively displace the switch actuation means at least during part of the movement of the operating means, said connection plate carrying pins which extend into slots of said switch actuating means and said operating means, biasing means applying a biasing force to said connection plate in toggle like manner, said connection plate being responsive in rotation to the rotation of said operating means by coupled engagement via at least one of said pins prior to reaching said toggle point whereupon said connection plate by coupled engagement via at least one of said pins with said switch actuation means rotate said switch actuation means under the urge of said biasing means from one of the first and second position to the other, and wherein a pawl is provided to lock rotation of said switch actuating means by its engagement with a pawl engageable notch in said switch actuating means when said switch is in its second rotational position.

2. An air break switch actuator as claimed in claim 1 wherein said biasing means acts on the connection means to bias the connection plate via a linkage means, there being provided as part of said linkage means a trigger means to move the direction of application of the biasing force at said toggle point.

3. An air break switch actuator as claimed in claim 2 wherein said trigger means is engaged to the linkage mechanism and becomes operative, to move the direction of the biasing force when said connection means is at the toggle point, the direction being displaced responsive to the movement of said connection plate.

4. An air break switch actuator as claimed in any one of claims 1 to 3 wherein said switch actuating means includes a switch lever rotatably movable about said axis between two positions corresponding to the open and closed positions of said switch.

5. An air break switch actuator as claimed in any one of claims 1 to 3 wherein said operating means includes an operating lever rotatably movable about said axis.

6. An air break switch actuator as claimed in claim 3 wherein said operating means includes an operating plate directly connected to and for rotation by said operating layer.

7. An air break switch actuator as claimed in claim 3 wherein said switch action means includes a switch plate directly connected to said switch lever to operate the rotation of said switch lever respondent to the displacement thereof by the connection plate.

8. An air break switch actuator as claimed in any one of claims 1 to 3 wherein at least one of said pins of said connection plate is engaged to and to displace said switch plate when said connection plate rotates through and beyond said toggle point.

9. An air break actuator as claimed in claim 3 wherein said slot of said switch plate is of identical shape to the slot of said operating plate.

10. An air break switch actuator as claimed in claim 3 wherein said slot of said operating plate, when said connection plate is at its extremes of rotation, is in alignment with the slot of said switch plate.

11. An air break switch actuator as claimed in claim 3 wherein said connection plate is intermediate of the operating plate and said switch plate, said pins extend parallel to said axis.

12. An air break switch actuator as claimed in claim 3 wherein said operating plate has two slots and said switch plate has two slots, said connection plate providing two pins, one for each of the pairs of slots.

13. An air break switch actuator as claimed in claim 3 wherein said linkage means includes a connection rod acting directly on and at a circumferential point of the connection plate, said connection rod connected to a crank pivoted about a fulcrum provided by said trigger means, wherein said biasing means is provided to act on said crank to bias said connection rod toward said connection plate.

14. An air break switch actuator as claimed in claim 3 wherein said trigger means is pivotably located to said structure providing means to displace said fulcrum with a component of movement in a direction tangential to the arc of movement of the connection point of the connection rod to the connection plate.

15. An air break switch actuator as claimed in claim 3 wherein said pawl is movably mounted from said structure providing means to selectively lock the rotation of the switch plate.

16. An air break switch actuator as claimed in claim 15 wherein said pawl is able to move between a retracted condition and a locking position, wherein in a locking position it is able to engage with a complementary shaped notch of said switch plate.

17. An air break switch actuator as claimed in claim 16 wherein said pawl is movable from said engaged condition to said retracted condition, respondent to the rotational position of said connection plate, by a cam follower which follows the contour of an appropriately shaped cammed surface of said connection plate.

18. An air break switch actuator as claimed in claim 16 or 17 wherein said pawl is movable from said retracted condition to said engaged condition, respondent to the rotational position of said connection plate, by a cam follower which is biased towards and to follow the contour of an appropriately shaped cammed surface of said connection plate.

19. The use of an actuator as claimed in any one of claims 1 to 18 for the control of an air brake switch between an open and closed position of the air brake switch.

20. A switch actuator to move a switch between a first and second position corresponding to an open and closed position of the switch, said actuator comprising or including:

a first rotatable member in mechanical connection with and to move said switch between said open and closed position by the rotation of said rotatable member about an axis, a second rotatable member in mechanical connection with an actuator, and rotatable about said axis, a connection member rotatable about said pivot axis, said connection member biased by a biasing means for rotation about said pivot axis in a toggle manner between a first angular position and a second angular position, said connection member providing a mechanical connection means to locate:

(a) against a fixed point of, and be displaced by, said second rotatable means at least during the rotation of the connection member by the second rotation means towards the point of toggle of the connection means, and (b) against a fixed point of and to thereby displace, the first rotatable member at least during rotation of said connection member passed said point of toggle wherein a pawl is provided to lock rotation of said first rotatable member by its engagement with a pawl engageable notch in said first rotatable member when said switch is in its closed condition.

21. A switch actuator as claimed in claim 20 wherein said fixed points of said first and second rotatable members are the distal ends of at least one slot provided in each of said first and second rotatable members, said mechanical connection means extending into each of said slots.

22. A switch actuator as claimed in claim 20 or 21 wherein said biasing means acts on the connection member to bias the connection member via a linkage means, there being provided as part of said linkage means a trigger means to move the direction of the biasing force applied by the biasing means to the connection member dependent on the angular position of said connection member.

23. A switch actuator as claimed in claim 22 wherein said trigger means is engaged to the linkage member and becomes operative to move the direction of the biasing force, when said connection member approaches a point of rotation nearing the toggle point, by being triggered by the movement of said connection member.

24. A switch actuator as claimed in claim 23 wherein said linkage means is configured such that said trigger is actuated by the movement of said connection member to advance the toggle point to occur earlier in the rotation of said connection member.

25. The use of an actuator as claimed in any one of claim 20 or 21 for the control of an air brake switch between an open and closed position of the air brake switch.

* * * * *